US007775303B2

(12) United States Patent
Göting

(10) Patent No.: US 7,775,303 B2
(45) Date of Patent: Aug. 17, 2010

(54) DEVICE FOR A DRILLING TOOL

(76) Inventor: Ove Göting, Spangbergsvagen, 13, S-682 31, Filipstad (SE)

( * ) Notice: Subject to any disclaimer, the term of this patent is extended or adjusted under 35 U.S.C. 154(b) by 165 days.

(21) Appl. No.: 11/547,688

(22) PCT Filed: Apr. 6, 2005

(86) PCT No.: PCT/SE2005/000502

§ 371 (c)(1),
(2), (4) Date: May 21, 2007

(87) PCT Pub. No.: WO2005/098194

PCT Pub. Date: Oct. 20, 2005

(65) Prior Publication Data

US 2007/0261892 A1 Nov. 15, 2007

(30) Foreign Application Priority Data

Apr. 7, 2004 (SE) ..... 0400929

(51) Int. Cl.
*E21B 10/30* (2006.01)
*E21B 10/26* (2006.01)

(52) U.S. Cl. ..... 175/389; 175/344; 175/385; 175/406

(58) Field of Classification Search ..... 175/258, 175/257, 260, 262, 263, 273, 284, 292, 384, 175/389, 398, 259, 261, 344, 385, 406
See application file for complete search history.

(56) References Cited

U.S. PATENT DOCUMENTS

| | | | | |
|---|---|---|---|---|
| 2,086,680 | A * | 7/1937 | Scott et al. | 175/344 |
| 3,753,470 | A * | 8/1973 | Lagerstrom et al. | 175/292 |
| 4,591,010 | A | 5/1986 | Persson | |
| 4,770,259 | A * | 9/1988 | Jansson | 175/258 |
| 6,516,899 | B2 * | 2/2003 | Wentworth et al. | 175/61 |

FOREIGN PATENT DOCUMENTS

| | | |
|---|---|---|
| SE | 458 943 | 5/1989 |
| SE | 460 141 | 9/1989 |
| SE | 522 135 | 1/2004 |
| WO | WO 03/004824 A1 | 1/2003 |

OTHER PUBLICATIONS

International Search Report dated Jun. 27, 2005.

* cited by examiner

*Primary Examiner*—Jennifer H Gay
*Assistant Examiner*—Yong-Suk Ro
(74) *Attorney, Agent, or Firm*—McGinn IP Law Group, PLLC

(57) ABSTRACT

An apparatus for a drilling tool includes a pilot drilling bit, a reamer, and a pilot body which is disposed to support the reamer and the pilot drilling bit at the end of a casing tube. The reamer includes a closed position in which the parts of the tool are concentric with one another and displaceable through the casing tube, and an open position in which at least a part of the reamer is located radially outside the casing tube. The pilot body includes a male portion which extends through the reamer, the male portion of the pilot body forming a cam surface for transferring rotation energy to the reamer and for switching the reamer between the closed and open positions, and the male portion of the pilot body being insertable in a recess in the pilot drilling bit.

22 Claims, 3 Drawing Sheets

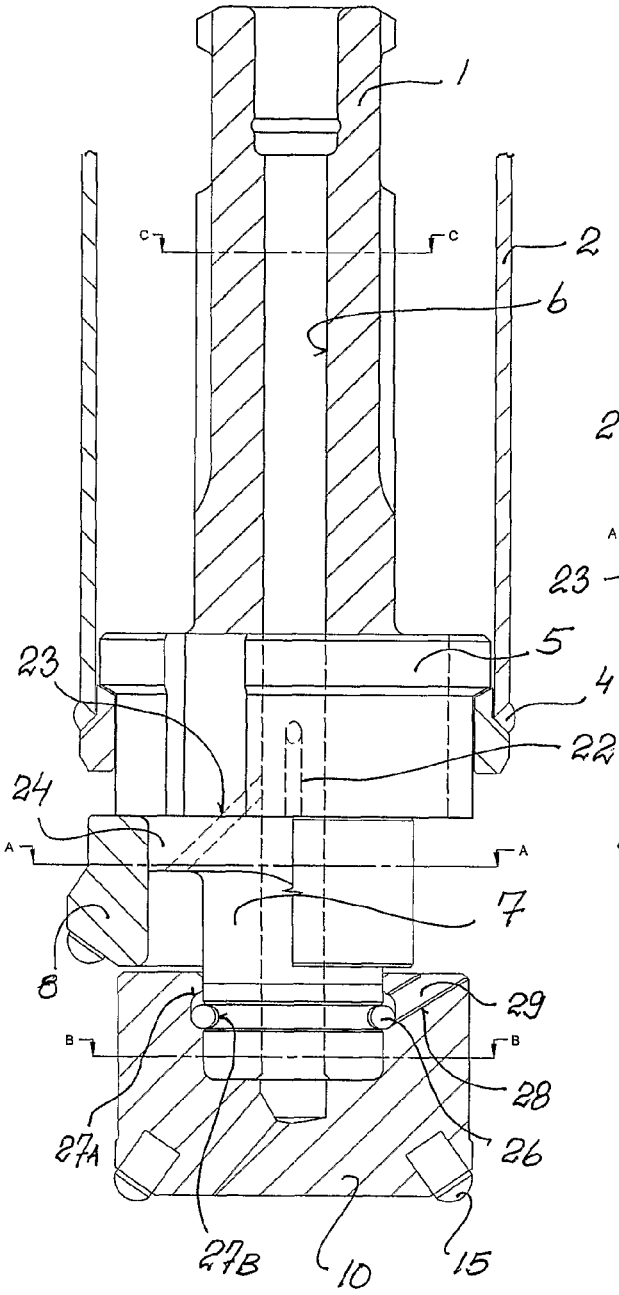
Fig 5
Fig 8
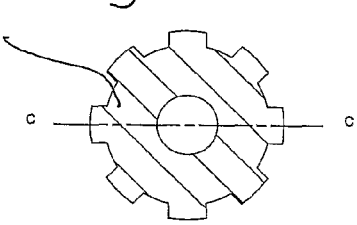
Fig 6
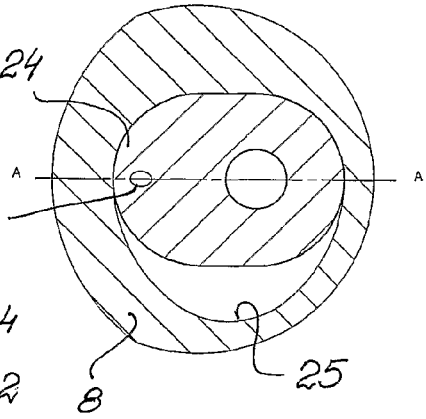
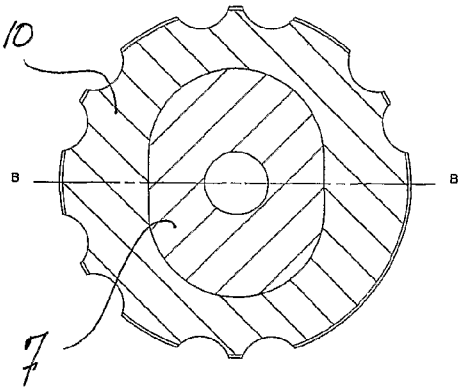
Fig 7

DEVICE FOR A DRILLING TOOL

The present invention relates to an apparatus in a tool for drilling.

According to the prior art technology, the transfer of the rotational force to the pilot drilling bit takes place from the pilot body via the reamer or vice versa. This has proved to be a drawback because of severe wear damage and thereby considerably reduced service life to the parts included in the power train. This wear damage and also failure occur because the heavy combination of the pilot drilling bit and the eccentric reamer entails high torque resistance and breakage forces on the coupling between the shaft of the pilot drilling bit and the pilot body. In addition, there is a major risk of oblique loading on the parts of prior art tool arrangements with the probability of failure and reduced service life.

SUMMARY OF THE INVENTION

The task forming the basis of the present invention is to realise an apparatus displaying considerably improved properties compared with the prior art.

This task has been solved according to the present invention.

The present invention realises an apparatus with considerably more favourable power distribution between the pilot body and the pilot drilling bit as well as the reamer than in prior art apparatuses. To a considerable extent, the service life of the apparatus will be greatly prolonged in that excessive and oblique driving and breakage forces are avoided. Further, the coupling between the pilot body and the pilot drilling bit is only subjected to loadings from percussion and rotation energy transfer from the pilot body to the pilot drilling bit, while the transfer of percussion and rotation energy to the reamer takes place from the pilot body without the coupling between the polity body and the pilot drilling bit being affected. The present invention further also makes possible a reduction of the weight of the parts included, which entails a considerable improvement in the efficiency of the drilling work.

BRIEF DESCRIPTION OF THE DRAWINGS

The present invention will be described in greater detail below with reference to the accompanying drawings.

FIG. 5 shows a similar view to FIG. 3 of yet a further embodiment of the apparatus according to the present invention;

FIG. 6 shows a section taken along the line A-A in FIG. 5; and

FIG. 7 shows a section taken along the line B-B in FIG. 5.

FIG. 8 shows a section taken along the line C-C in FIG. 5.

BRIEF DESCRIPTION OF THE EMBODIMENTS OF THE INVENTION

Figure 1:
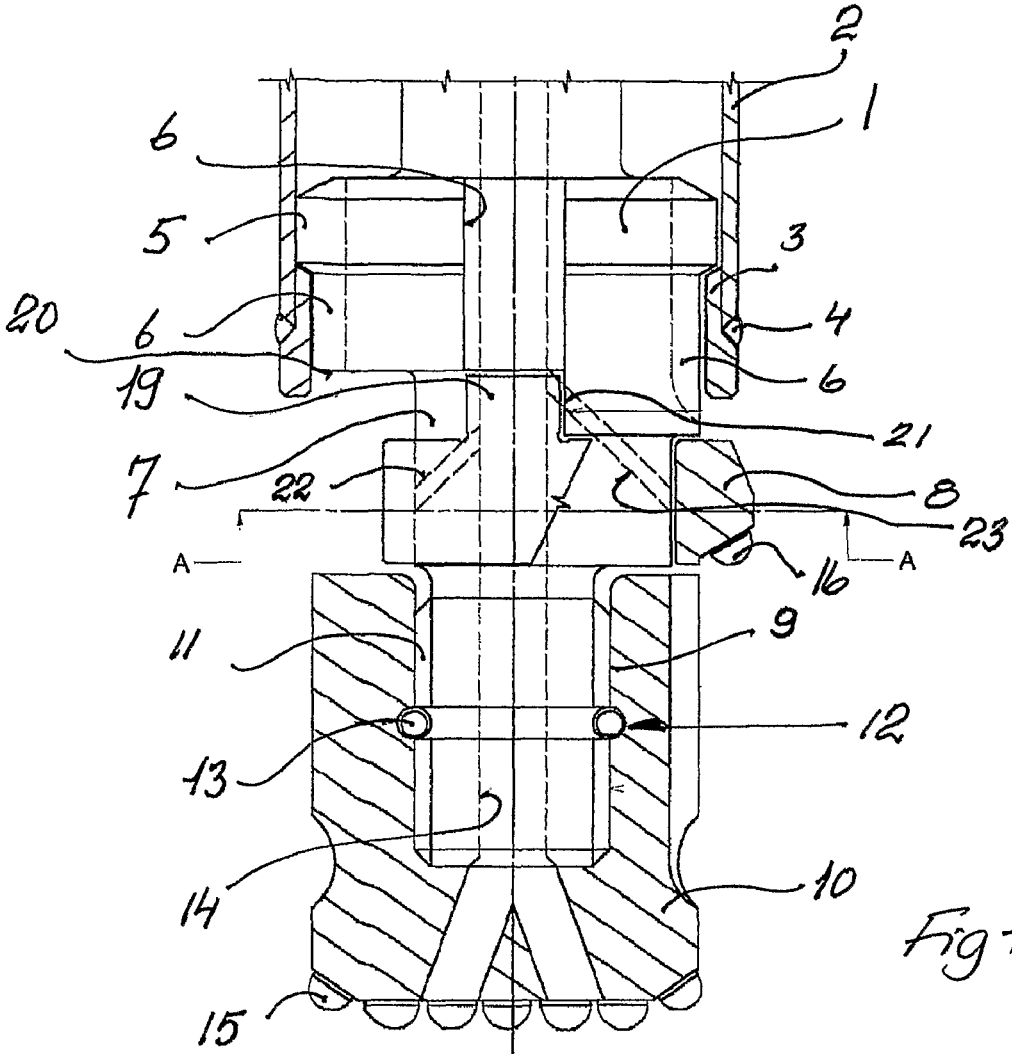
FIG. 1 shows a view partly in section of one embodiment of an apparatus according to the present invention.
Figure 2:
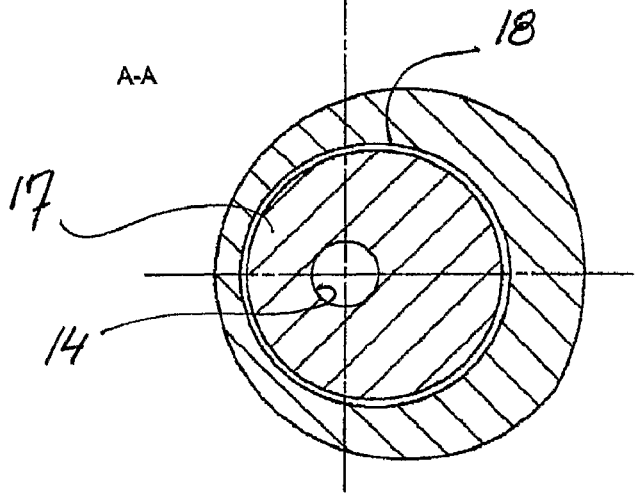
FIG. 2 shows a section taken along the line A-A in FIG. 1.

The embodiment of an apparatus according to the present invention illustrated in FIGS. 1 and 2 comprises a pilot body 1 which is located inside a casing tube 2 and is coupled to a drilling rod which extends inside the casing tube 2 and serves for rotating the pilot body clockwise. The pilot body 1 is given percussion energy by means of a down the hole drill hammer or a top hammer, both of which, together with the drilling rod, being of per se conventional type and will not be described in greater detail in the following description. The apparatus according to the present invention may also be used in rotation drilling without percussion.

The casing tube 2 has, at its mouth, a percussion block 3 which is welded to the casing tube 2 by means of a weld 4. The pilot body 1 has a radial waist 5 which fits in the casing tube while the remaining part of the pilot body 1 fits in the percussion block 3. The waist 5 on the pilot body 1 serves for guiding the pilot body 1 as well as tool parts carried thereby in the casing tube 2, and also for transferring percussion energy to the percussion block 3. This percussion energy serves for driving the casing tube 2 down into a hole. The pilot body 1 further has channels 6 which extend in the circumferential surface and serve for the passage of flushing liquid or flushing gas and for cuttings created by the tool work.

The pilot body 1 has a male portion 7 extending out from the casing tube 2 and the percussion block 3. The male portion 7 extends through a reamer 8. The end of the male portion 7 extends into a recess 9 in a pilot drilling bit 10. The male portion 7 is anchored in the recess 9 of the pilot drilling bit 10 by means of suitable threading 11. Further, the male portion 7 and the pilot drilling bit 10 are anchored to one another with the aid of a locking device 12. The locking device 12 may suitably consist of a sliding pin 13 in a groove which is located in both the recess of the pilot drilling bit and on the male portion, as is illustrated in FIG. 1. The threading 11 serves for transferring rotation and percussion energy from the pilot body 1 to the pilot drilling bit 10.

Through the male portion 7 and the pilot drilling bit 10 extends a flushing channel 14 which, as is illustrated, may be divided into a plurality of channels though the pilot drilling bit 10. The pilot drilling bit 10 is, in a per se known manner, provided with a number of wear bodies 15 for example cemented carbide pins, in a per se known manner.

Between the pilot body 1 and the pilot drilling bit 10, a reamer 8 is disposed on the male portion 7 and is also provided with wear bodies 16, for example cemented carbide pins of per se known type. Flush with the reamer 8, the male portion 7 is provided with an eccentric portion 17 and the reamer 8 is provided with a corresponding eccentric recess 18. The eccentric portion 17 includes a cam surface on the pilot body 1 which cooperates with an eccentric hole in the reamer for rotation of the reamer and switching of the reamer between closed and open positions. In FIGS. 1 and 2, the reamer 8 is shown in an open position in which the reamer 8 extends radially further out from the centre axis of the apparatus than the casing tube 2 with a view to realising a space for the casing tube 2 in the drilled hole. The reamer 8 further carries a pin or heel 19 extending axially towards the pilot body 1. The end of the pilot body 1 facing towards the reamer 8 displays a recess 20 for the heel 19 and an axial driving- or contact surface 21 which serves for transferring rotation energy to the heel 19 and thereby the reamer 8. The pilot body 1 has a contact surface on the opposing side in relation to the contact surface 21 for contact with the opposing surface of the heel 19 in relation to the contact surface 21 for switching the reamer from the illustrated open position to a closed position in which the radial extent of the reamer 8 is less than the outer diameter of the pilot drilling bit 10 and in which the pilot body 1 and the parts carried thereby may therefore be displaced into the casing tube 2 through the percussion block 3.

The male portion 7 displays additional channels 22 and 23 for flushing liquid or flushing gas. The channels 14, 22 and 23 serve, as was mentioned above, for transferring flushing liquid or flushing gas.

In the above-described embodiment of an apparatus according to the present invention, the transfer of both percussion energy and rotation energy to the pilot drilling bit 10 takes place via the male portion 7, while both rotation and percussion energy are transferred to the reamer 8 only via the pilot body 1 and the male portion 7. The coupling in the pilot drilling bit 10 between the male portion 7 and the bit will thus not be affected by the energy which is transferred to the reamer. The threading 11 may be of any suitable type whatever.

Figure 3:
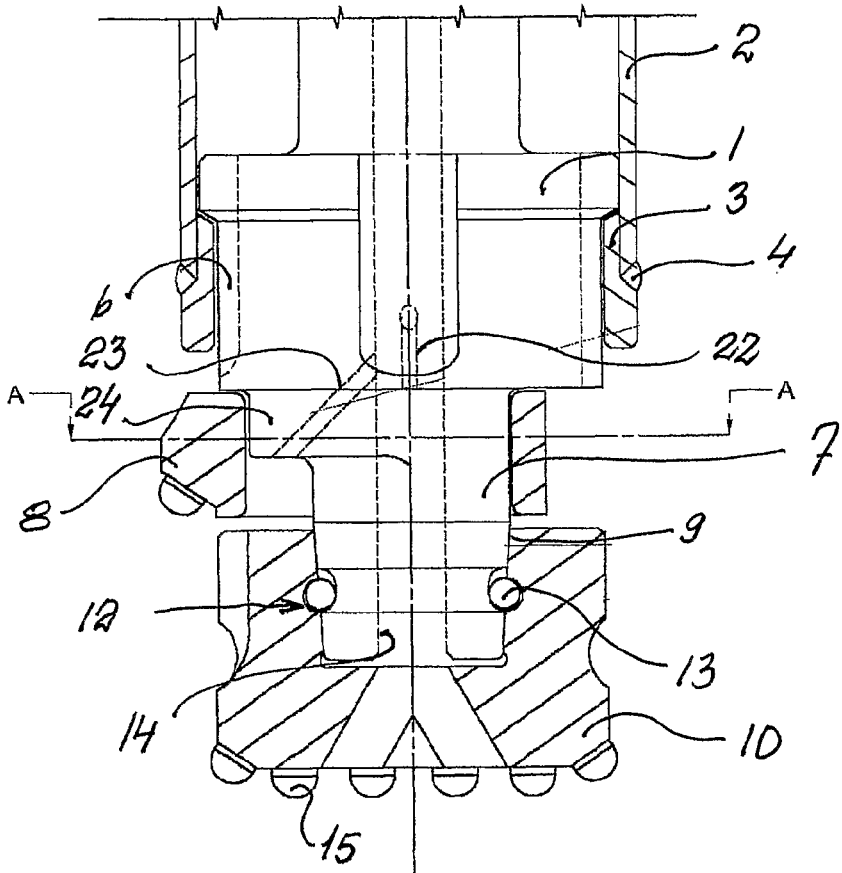
FIG. 3 shows a view partly in section of another embodiment of an apparatus according to the present invention.
Figure 4:
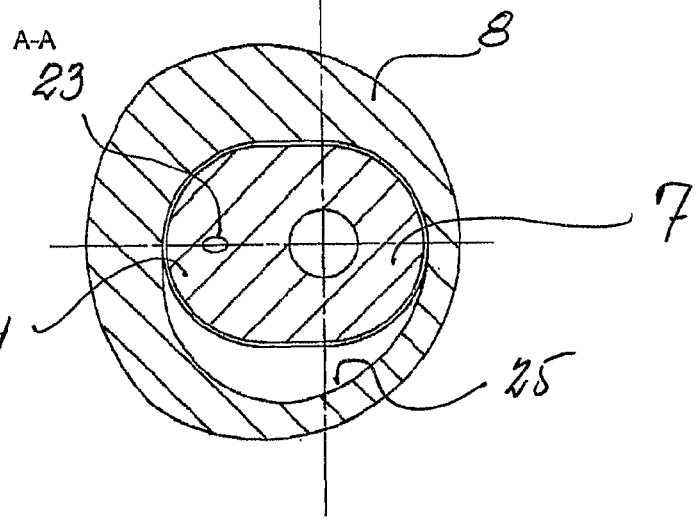
FIG. 4 shows a section taken along the line A-A in FIG. 3.

FIGS. 3 and 4 show another embodiment of an apparatus according to the present invention. The same parts as in the above-described embodiment carry the same reference numerals. The major difference between the embodiment described in the foregoing and the embodiment illustrated in FIGS. 3 and 4 resides in the design of the male portion 7 on the pilot body 1 and the parts carried thereby. The end of the male portion 7 in the recess 9 of the pilot drilling bit 10 is conical and is locked in the recess 9 by means of a locking device 12 which includes a flexible sliding pin 13. Flush with the reamer 8, the male portion 7 has a radial flare 24 while the reamer 8 has a fitting recess 25. The flare 24 serves for transferring rotation energy to the reamer 8 on clockwise rotation. In the position illustrated in FIG. 4, the reamer 8 is located in its outer position in which the outer diameter of the reamer is larger than the outer diameter of the casing tube 2, as is clearly apparent in FIG. 3. On counterclockwise rotation of the male portion 7 and thereby the pilot body 1, the flare 24 will switch the reamer 8 from the position illustrated in the Drawing to its inwardly closed position, in which its outer diameter is less than the inner diameter of the percussion block 3, whereby the pilot body 1, the reamer 8 and the pilot drilling bit 10 may be axially displaced therethrough and the casing tube 2.

Also in this embodiment, transfer of rotation and percussion energy takes place to both the pilot drilling bit 10 and the reamer 8 via the male portion 7 of the pilot body 1. Nor in this embodiment does any energy transfer take place from the pilot drilling bit 10 to the reamer 8.

FIGS. 5 to 8 show yet a further embodiment of an apparatus according to the present invention. The same parts as in the above embodiments carry the same reference numerals. The major difference resides in the design of the coupling between the male portion 7 of the pilot body 1 and the pilot drilling bit 10.

In this embodiment, the end of the male portion 7 is oval in such a manner that the cylinder is divided and the parts are separated and connected to one another by straight lines, as is clearly apparent from FIG. 7. This end of the male portion 7 fits in a likewise oval hole in the pilot drilling bit 10. The parts are interconnected to one another by means of locking balls 26 in a ball race 27A in the pilot drilling bit 10 and a ball race 27B in the end of the male portion 7. A hole 28 in the pilot drilling bit 10 leads to the ball race 27A. The hole 28 is intended for a plug 29 of rubber or some similar material and extends in between the balls 26 in the ball race 27B. The inside of the hole 28 is advantageously grooved for retaining the plug 29 in the hole 28. This grooving is easy to realise in that the hole 28 is threaded. In such an event, it is simple to break the thread crests by means of a drill of suitable dimension. A part of an O-ring gasket of suitable dimension is appropriate to use as the plug 29.

In top hammer drilling, the rotation generally takes place counterclockwise and then the switching of the reamer between open and closed position is effected by rotation of the pilot body in the opposite direction in relation to the above-described direction in connection with down the hole drilling.

Many modifications are naturally possible without departing from the scope of the inventive concept as defined in the appended Claims.

The invention claimed is:

1. An apparatus for a drilling tool, comprising:

a pilot drilling bit;

a reamer; and a pilot body which is disposed to support the reamer and the pilot drilling bit at the end of a casing tube, wherein the reamer includes a closed position in which the reamer is located radially inside the casing tube and displaceable through the casing tube, and an open position in which at least a part of the reamer is located radially outside the casing tube, wherein the pilot body comprises a male portion which extends through the reamer and is inserted into a recess in the pilot drilling bit, the male portion of the pilot body forming a cam surface for transferring rotation energy to the reamer and for switching the reamer between said closed and open positions, and wherein the male portion comprises a first portion having an oblong-shaped cross section and located radially inside an upper axial end of the reamer, and a second portion having a diameter which is less than a diameter of the first portion and located radially inside a lower axial end of the reamer which is adjacent the pilot drilling bit.

2. The apparatus as claimed in claim 1, wherein the male portion is provided with a thread, and the recess in the pilot drilling bit is provided with a corresponding thread.

3. The apparatus as claimed in claim 2, further comprising:

locking means disposed between the pilot body and the pilot drilling bit for counteracting axial displacement thereof.

4. The apparatus as claimed in claim 3, wherein the locking means comprises balls in ball races, and the balls are enclosed in the ball race by a plug which is disposed in a hole in the pilot drilling bit.

5. The apparatus as claimed in claim 1, wherein the male portion of the pilot body comprises a conical portion, and the recess in the pilot drilling bit is conical.

6. The apparatus as claimed in claim 5, further comprising:

locking means disposed between the pilot body and the pilot drilling bit for counteracting axial displacement thereof.

7. The apparatus as claimed in claim 6, wherein the locking means comprises balls in ball races, and the balls are enclosed in the ball race by a plug which is disposed in a hole in the pilot drilling bit.

8. The apparatus as claimed in claim 1, further comprising:

locking means disposed between the pilot body and the pilot drilling bit for counteracting axial displacement thereof.

9. The apparatus as claimed in claim 8, wherein the locking means comprises balls in ball races, and the balls are enclosed in the ball race by a plug which is disposed in a hole in the pilot drilling bit.

10. The apparatus as claimed in claim 1, wherein the reamer comprises an axial pin for cooperation with a drive surface on the pilot body for rotation of the reamer.

11. The apparatus as claimed in claim 1, wherein the cam surface on the pilot body comprises an eccentric portion for cooperation with an eccentric hole in the reamer for rotation of the reamer and switching thereof between closed and open position.

12. The apparatus as claimed in claim 1, wherein the end of the male portion comprises an oval shape and fits in an oval hole in the pilot drilling bit.

13. The apparatus as claimed in claim 12, further comprising:

locking means disposed between the pilot body and the pilot drilling bit for counteracting axial displacement thereof, wherein the locking means comprises balls in ball races, and the balls are enclosed in the ball race by a plug which is disposed in a hole in the pilot drilling bit.

14. The apparatus of claim 1, further comprising:

a locking device for locking an end of said male portion in said recess of said pilot drilling bit.

15. The apparatus of claim 14, wherein said locking device comprises a sliding pin formed between said pilot drilling bit and said male portion of said pilot body.

16. The apparatus of claim 15, wherein said pilot drilling bit and recess in said male portion comprise a groove, said sliding pin being located in said groove.

17. The apparatus as claimed in claim 1, wherein said male portion comprises an outer wall including said cam surface, said reamer comprising an inner wall formed around said outer wall of said male portion.

18. The apparatus as claimed in claim 1, wherein said male portion comprises a first section including an outer wall including said cam surface which contacts an inner wall of said reamer, and a second section which is inserted into said pilot drilling bit, said first section having a cross-sectional diameter which is greater than a cross-sectional diameter of said second section.

19. The apparatus as claimed in claim 18, wherein, said first section of said male portion comprises an oval shape, said male portion comprising a flushing channel which is formed in an axial direction and is eccentrically disposed in said first section of said male portion.

20. The apparatus as claimed in claim 19, wherein said flushing channel is concentrically disposed in said second section of said male portion.

21. A device for a drilling tool, comprising:

a reamer having a closed position in which the reamer is located radially inside a casing tube and displaceable through the casing tube, and an open position in which at least a part of the reamer is located radially outside the casing tube;

a pilot drilling bit; and a pilot body which supports the reamer and the pilot drilling bit at the end of the casing tube, the pilot body including a male portion which is insertable in a recess in the pilot drilling bit and extends through the reamer and forms a cam surface for transferring rotation energy to the reamer for switching the reamer between said closed and open positions, wherein the male portion comprises a first portion having an oblong-shaped cross section an located radially inside an upper axial end of the reamer, and a second portion having a diameter which is less than a diameter of the first portion and located radially inside a lower axial end of the reamer which is adjacent the pilot drilling bit.

22. A drilling tool, comprising:

a reamer having a closed position in which the reamer is located radially inside a casing tube and displaceable through the casing tube, and an open position in which at least a part of the reamer is located radially outside the casing tube;

a pilot drilling bit; and a pilot body which supports the reamer and the pilot drilling bit at the end of the casing tube, the pilot body including a male portion which is insertable in a recess in the pilot drilling bit and extends through the reamer and forms a cam surface for transferring rotation energy to the reamer for switching the reamer between said closed and open positions, wherein the male portion comprises a first portion having an oblong-shaped cross section and located radially inside an upper axial end of the reamer, and a second portion having a diameter which is less than a diameter of the first portion and located radially inside a lower axial end of the reamer which is adjacent the pilot drilling bit.

* * * * *